US012213525B2

(12) United States Patent
Simpson et al.

(10) Patent No.: US 12,213,525 B2
(45) **Date of Patent: *Feb. 4, 2025**

(54) AEROSOL SOURCE FOR A VAPOR PROVISION SYSTEM

(71) Applicant: NICOVENTURES TRADING LIMITED, London (GB)

(72) Inventors: Alexander Simpson, London (GB); Terry Lee Angell, London (GB)

(73) Assignee: NICOVENTURES TRADING LIMITED, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 18/299,163

(22) Filed: Apr. 12, 2023

(65) Prior Publication Data

US 2023/0284694 A1 Sep. 14, 2023

Related U.S. Application Data

(63) Continuation of application No. 16/497,262, filed as application No. PCT/GB2018/050726 on Mar. 21, 2018, now Pat. No. 11,653,701.

(30) Foreign Application Priority Data

Mar. 24, 2017 (GB) ..... 1704674

(51) Int. Cl.
*A24F 40/44* (2020.01)
*A24F 40/42* (2020.01)
(Continued)

(52) U.S. Cl.
CPC ..... *A24F 40/44* (2020.01); *A24F 40/42* (2020.01); *A24F 40/46* (2020.01); *A24F 40/485* (2020.01); *A24F 40/10* (2020.01)

(58) Field of Classification Search
None
See application file for complete search history.

(56) References Cited

U.S. PATENT DOCUMENTS 6,196,218 B1 3/2001 Voges
8,061,361 B2 11/2011 Maeder et al.
(Continued)

FOREIGN PATENT DOCUMENTS

CN 201781984 4/2011
CN 201830900 U 5/2011
(Continued)

OTHER PUBLICATIONS

Communication pursuant to Article 94(3) EPC for European Application No. 18715070.1, mailed Aug. 4, 2022, 6 pages.
(Continued)

*Primary Examiner* — James Harvey
(74) *Attorney, Agent, or Firm* — Husch Blackwell

(57) ABSTRACT

An aerosol source for an electronic vapor provision system includes a heating element; an atomizing chamber; a reservoir for holding free-flowing source liquid; and a porous wick extending from the atomizing chamber to the reservoir and comprising a heater portion in cooperation with the heating element within the atomizing chamber and at least one liquid collecting portion within the reservoir, the liquid collecting portion having a maximum cross-sectional parameter that is greater than an equivalent cross-sectional parameter of the heater portion.

20 Claims, 7 Drawing Sheets

(51) Int. Cl.

| | |
|---|---|
| ***A24F 40/46*** | (2020.01) |
| ***A24F 40/485*** | (2020.01) |
| *A24F 40/10* | (2020.01) |

(56) References Cited

U.S. PATENT DOCUMENTS

| | | | | |
|---|---|---|---|---|
| 10,258,087 | B2 | 4/2019 | Kane | |
| 11,388,931 | B2 | 7/2022 | Potter et al. | |
| 2013/0087160 | A1 | 4/2013 | Gherghe | |
| 2013/0228191 | A1 | 9/2013 | Newton | |
| 2013/0306065 | A1 | 11/2013 | Thorens et al. | |
| 2014/0123989 | A1 | 5/2014 | Lamothe | |
| 2014/0130816 | A1 | 5/2014 | Liu | |
| 2014/0238424 | A1 | 8/2014 | Macko | |
| 2015/0040927 | A1 | 2/2015 | Li | |
| 2015/0272220 | A1 | 10/2015 | Spinka et al. | |
| 2015/0313283 | A1 | 11/2015 | Collett et al. | |
| 2016/0015082 | A1 | 1/2016 | Liu | |
| 2016/0073692 | A1 | 3/2016 | Alarcon et al. | |
| 2016/0121058 | A1 | 5/2016 | Chen | |
| 2016/0316819 | A1 | 11/2016 | Zhou et al. | |
| 2016/0345632 | A1 | 12/2016 | Lipowicz | |
| 2016/0353800 | A1 | 12/2016 | Di Carlo | |
| 2017/0273359 | A1 | 9/2017 | Liu | |
| 2017/0303596 | A1 | 10/2017 | Chen | |
| 2020/0352238 | A1 | 11/2020 | Simspon | |
| 2020/0359704 | A1* | 11/2020 | Deng | A24F 40/70 |
| 2021/0093005 | A1* | 4/2021 | Potter | A24F 40/42 |
| 2023/0284694 | A1* | 9/2023 | Simpson | A24F 40/42 |

FOREIGN PATENT DOCUMENTS

| | | | |
|---|---|---|---|
| CN | 103380952 | A | 11/2013 |
| CN | 204120237 | U | 1/2015 |
| CN | 204351068 | U | 5/2015 |
| CN | 104720117 | A | 6/2015 |
| CN | 204426699 | U | 7/2015 |
| CN | 204483034 | U | 7/2015 |
| CN | 204483035 | U | 7/2015 |
| CN | 105163614 | A | 12/2015 |
| CN | 105188428 | A | 12/2015 |
| CN | 105208882 | A | 12/2015 |
| CN | 105310114 | A | 2/2016 |
| CN | 105342010 | A | 2/2016 |
| CN | 105433442 | A | 3/2016 |
| CN | 205285008 | U | 6/2016 |
| CN | 205512338 | U | 8/2016 |
| CN | 205624465 | U | 10/2016 |
| CN | 106376976 | A | 2/2017 |
| CN | 206119177 | U | 4/2017 |
| CN | 206197019 | U | 5/2017 |
| CN | 206197020 | U | 5/2017 |
| CN | 107708452 | A | 2/2018 |
| EP | 2460424 | A1 | 6/2012 |
| EP | 2823720 | | 1/2015 |
| EP | 2984952 | A1 | 2/2016 |
| EP | 3108759 | | 12/2016 |
| EP | 2959784 | | 8/2017 |
| GB | 2513639 | | 11/2014 |
| JP | 2015514504 | A | 6/2017 |
| KR | 20120098343 | A | 9/2012 |
| KR | 20140002774 | | 5/2014 |
| RU | 2425608 | C2 | 8/2011 |
| RU | 2606572 | C2 | 1/2017 |
| RU | 2620754 | C2 | 5/2017 |
| RU | 2639972 | C2 | 12/2017 |
| WO | 2011146375 | A2 | 11/2011 |
| WO | 2016079151 | A1 | 5/2016 |
| WO | 2016176800 | | 11/2016 |
| WO | 2016190222 | A1 | 12/2016 |
| WO | 2016198417 | A1 | 12/2016 |
| WO | 2016208756 | A1 | 12/2016 |
| WO | 2016207357 | A1 | 1/2017 |
| WO | 2017001818 | A1 | 1/2017 |
| WO | 2017001819 | A1 | 1/2017 |
| WO | 2017015832 | A1 | 2/2017 |
| WO | 2017215221 | A1 | 12/2017 |

OTHER PUBLICATIONS

International Preliminary Report on Patentability for Application No. PCT/GB2019.050037, mailed on May 8, 2020, 21 pages.
International Preliminary Report on Patentability for Application No. PCT/GB2019/050186, mailed on May 8, 2020, 8 pages.
International Search Report and Written Opinion for Application No. PCT/GB2019/050037, mailed on Mar. 25, 2019, 12 pages.
Notice of Reasons for Rejection for Japanese Application No. 2020-539826, mailed Jun. 15, 2021, 14 pages.
Office Action for Japanese Patent Application No. 2020-537201, mailed on Jul. 13, 2021, 5 pages.
Office Action for Russian Application No. 2020124567, mailed on Jan. 28, 2021, 2 pages.
Search Report for Russian Application No. 2020124379, mailed on Mar. 2, 2021, 2 pages.
Office Action for Chinese Application No. 201880020522.4, mailed on May 20, 2022, 12 pages.
Office Action for Canadian Application No. 3089292, mailed on Dec. 16, 2021, 6 pages.
Second Office Action mailed Jan. 20, 2022 for Chinese Application No. 201880020522.4, 17 pages.
Communication pursuant to Article 94(3) EPC for Application No. 18715070.1, mailed on Nov. 2, 2020, 21 pages.
International Preliminary Report on Patentability for Application No. PCT/GB2019/050187, mailed on Aug. 6, 2020, 3 pages.
International Preliminary Report on Patentability for Application No. PCT/GB2019/050187, mailed on Jul. 28, 2020, 7 pages.
International Search Report for Application No. PCT/GB2019/050187, mailed on Apr. 18, 2019, 3 pages.
Office Action for Chinese Application No. 201880020522.4, mailed on Aug. 3, 2021, 14 pages.
Office Action for Korean Application No. 10-2019-7027899, mailed on Jan. 18, 2021, 17 pages.
Office Action for Korean Application No. 10-2019-7027899, mailed on Jul. 27, 2021, 15 pages.
Great Britain Search Report, Application No. GB1704674.9, dated Apr. 27, 2017, 5 pages.
International Search Report and Written Opinion, Application No. PCT/GB2018/050726, mailed Jun. 12, 2018, 15 pages.
International Preliminary Report on Patentability, Application No. PCT/GB2018/050726, mailed Jul. 3, 2019, 32 pages.
Great Britain Search Report, Application No. GB1702861.4, dated May 31, 2017, 5 pages.
Harry , "What's the Difference Between an Atomizer, Cartomizer and Clearomizer?", Vaporesso, Available at <https://www.vaporesso.com/blog/difference-between-an-atomizer-cartomizer-and-clearomizer>, Aug. 7, 2019, 6 pages.

* cited by examiner

AEROSOL SOURCE FOR A VAPOR PROVISION SYSTEM

PRIORITY CLAIM

The present application is a continuation application of U.S. patent application Ser. No. 16/497,262, filed Sep. 24, 2019, which is a National Phase entry of PCT Application No. PCT/GB2018/050726, filed Mar. 21, 2018, which claims priority from GB Patent Application No. 1704674.9, filed Mar. 24, 2017, each of which is hereby fully incorporated herein by reference.

TECHNICAL FIELD

The present disclosure relates to an aerosol source for an electronic vapor provision system such as an e-cigarette.

BACKGROUND

Many electronic vapor provision systems, such as e-cigarettes and other electronic nicotine delivery systems, are formed from two main components or sections, namely a cartomizer and a control unit (battery section). The cartomizer generally includes a reservoir of liquid and an atomizer for vaporizing the liquid. These parts may collectively be designated as an aerosol source. The atomizer may be implemented as an electrical (resistive) heater, such as a wire formed into a coil or other shape and a wicking element in proximity to the heater which transports liquid from the reservoir to the heater. The control unit generally includes a battery for supplying power to the atomizer. In operation, the control unit may be activated, for example by detecting when a user inhales on the device and/or when the user presses a button, to provide electrical power from the battery to the heater. This activation causes the heater to vaporize a small amount of liquid delivered by the wicking element from the reservoir, which is then inhaled by the user. A consistent and efficient generation of vapor requires effective wicking of the liquid from the reservoir by the wicking element. Accordingly, the configuration of the wicking element is of interest.

SUMMARY

According to a first aspect of some embodiments described herein, there is provided an aerosol source for an electronic vapor provision system comprising: a heating element; an atomizing chamber; a reservoir for holding free-flowing source liquid; a porous wick extending from the atomizing chamber to the reservoir and comprising a heater portion in cooperation with the heating element within the atomizing chamber and at least one liquid collecting portion within the reservoir, the liquid collecting portion having a maximum cross-sectional parameter that is greater than an equivalent cross-sectional parameter of the heater portion.

According to a second aspect of some embodiments described herein, there is provided an atomizer for an electronic vapor provision system comprising: a heating element; and a porous wick comprising a heater portion in cooperation with the heating element and at least one liquid collecting portion contiguous with the heater portion for placement in a reservoir of source liquid, the liquid collecting portion having a maximum cross-sectional parameter that is greater than an equivalent cross-sectional parameter of the heater portion.

According to a third aspect of some embodiments described herein, there is provided a wick for an atomizer of an electronic vapor provision system, made from porous material and comprising: a heater portion for cooperation with a heating element; and at least one liquid collecting portion contiguous with the heater portion for placement in a reservoir of source liquid, the liquid collecting portion having a maximum cross sectional parameter that is greater than an equivalent cross-sectional parameter of the heater portion. According to a fourth aspect of some embodiments described herein, there is provided a cartomizer for an electronic vapor provision system comprising an aerosol source according to the first aspect, or an atomizer according to the second aspect, or a wick according to the third aspect.

These and further aspects of the certain embodiments are set out in the appended independent and dependent claims. It will be appreciated that features of the dependent claims may be combined with each other and features of the independent claims in combinations other than those explicitly set out in the claims. Furthermore, the approach described herein is not restricted to specific embodiments such as set out below, but includes and contemplates any appropriate combinations of features presented herein. For example, an aerosol source or a vapor provision system including an aerosol source may be provided in accordance with approaches described herein which includes any one or more of the various features described below as appropriate.

BRIEF DESCRIPTION OF THE DRAWINGS

Various embodiments of the disclosure will now be described in detail by way of example only with reference to the following drawings in which.

DETAILED DESCRIPTION

Figure 1:
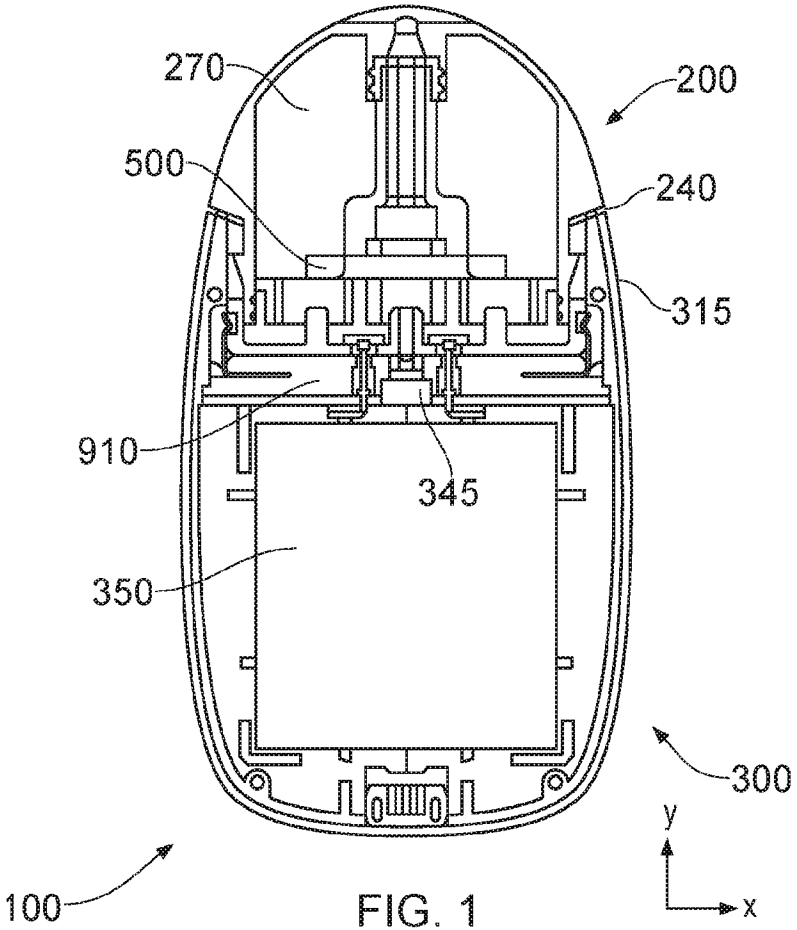
FIG. 1 shows a cross-section through an example e-cigarette comprising a cartomizer and a control unit in which embodiments may be implemented.

FIG. 1 shows a cross-sectional view through an e-cigarette 100 in accordance with some embodiments of the disclosure. The e-cigarette comprises two main components or sections, namely a cartomizer 200 and a control unit 300. As discussed in more detail below, the cartomizer 200 includes a chamber 270 defining a reservoir of source liquid, a heater (not shown in FIG. 1) to generate vapor from the source liquid, and a mouthpiece. The liquid in the reservoir 270 (sometimes referred to as source liquid or e-liquid) typically includes nicotine in an appropriate solvent, and may include further constituents, for example, to aid aerosol formation, and/or for additional flavoring. The cartomizer 200 further includes a wicking element (wick) 500, which provides a wicking, capillary or similar facility to transport a small amount of liquid from the reservoir 270 to a heating location on or adjacent the heater. The heater and the wick 500 may be collectively designated as an atomizer or vaporizer. The atomizer or vaporizer and the reservoir 270 may collectively be designated as an aerosol source. Therefore, the cartomizer 200 is the section of the e-cigarette 100 which, in this example, houses the atomizer and the aerosol source.

The control unit 300 includes a re-chargeable cell or battery 350 to provide power to the e-cigarette 100, a printed circuit board (PCB) for generally controlling the e-cigarette (not shown in FIG. 1), and a pressure sensor or airflow sensor 345 for detecting a user inhalation (via a pressure drop). When the heater receives power from the battery 350, as controlled by the PCB in response to the sensor 345 detecting a user puff on the e-cigarette 100, the heater vaporizes the liquid from the wick 500 and this vapor is then inhaled by a user through the mouthpiece.

For ease of reference, the x and y axes are marked in FIG. 1. The x axis will be referred to herein as the width of the device (from side to side), while the y axis will be referred to herein as the height axis, where the cartomizer 200 represents the upper portion of the e-cigarette 100 and the control unit 300 represents the lower portion of the e-cigarette 100. Note that this orientation reflects how a user holds the e-cigarette 100 during normal operation of the device, given that the wick 500 is located in the lower part of the reservoir 270 in the cartomizer 200. Therefore holding the e-cigarette 100 in this orientation brings the wick 500 into contact with liquid at the bottom of the reservoir 270. Other devices may have a wick oriented or positioned differently.

A z axis (not shown in FIG. 1) is also assumed, which is perpendicular to the x and y axes shown in FIG. 1. The z axis will be referred to herein as the depth axis. In this example the depth of e-cigarette 100 is significantly less than the width of the e-cigarette 100, thereby resulting in a generally flat or planar configuration (in the x-y plane). Accordingly, the z axis can be considered as extending from face to face of the e-cigarette 100, where one face may be regarded (arbitrarily) as the front face of the e-cigarette and the opposing face as the back face of the e-cigarette 100.

The cartomizer 200 and the control unit 300 are detachable from one another by separating in a direction parallel to the y-axis, but are joined together when the device 100 is in use so as to provide mechanical and electrical connectivity between the cartomizer 200 and the control unit 300. When the e-liquid in the reservoir 270 has been depleted, the cartomizer 200 can be removed and a new cartomizer attached to the control unit 300. Accordingly, the cartomizer 200 may sometimes be referred to as a disposable portion of the e-cigarette 100, while the control unit 300 represents a re-usable portion. In other examples, the cartomizer 200 may be configured such that the reservoir 270, when empty, can be refilled with liquid, so that the cartomizer can also be re-usable.

Figure 2:
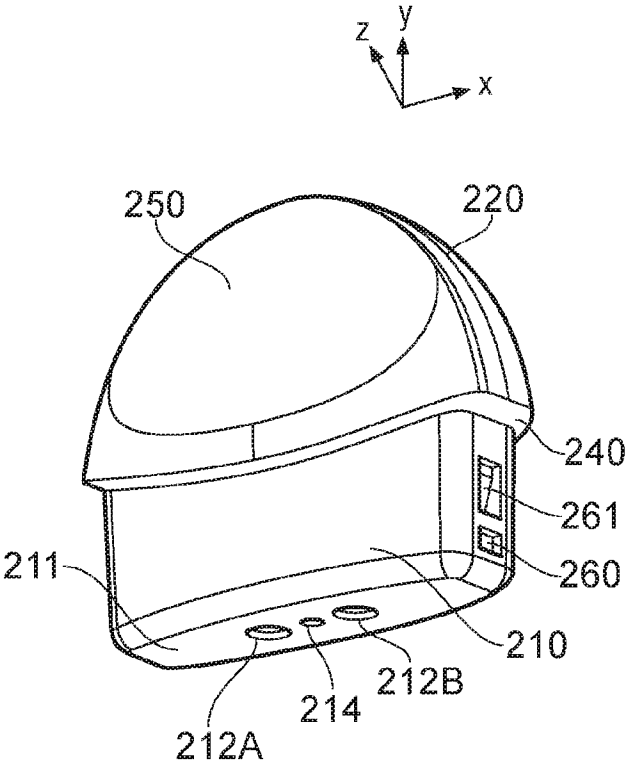
FIG. 2 shows a perspective external view of the cartomizer of FIG. 1.

FIG. 2 is a perspective external view of the cartomizer 200 of the e-cigarette of FIG. 1 in accordance with some embodiments of the disclosure. This external view confirms that the depth of the cartomizer 200 (and the e-cigarette 100 as a whole), as measured parallel to the z axis, is significantly less than the width of the cartomizer 200 (and the e-cigarette 100 as a whole), as measured parallel to the x axis.

The cartomizer 200 comprises two main portions (at least from an external viewpoint). In particular, there is a lower or base portion 210 and an upper portion 220. The upper portion 220 provides a mouthpiece 250 for the e-cigarette. When the cartomizer 200 is assembled with the control unit 300, the base portion 210 of the cartomizer sits within the control unit 300, and hence is not externally visible, whereas the upper portion 220 of the cartomizer protrudes above the control unit 300, and hence is externally visible. Accordingly, the depth and width of the base portion 210 are smaller than the depth and width of the upper portion 220, to allow the base portion 210 to fit within the control unit 300. The increase in depth and width of the upper portion 220 compared with the base portion 210 is provided by a lip or rim 240. When the cartomizer 200 is inserted into the control unit 300, this lip or rim 240 abuts against the top of the control unit 300.

As shown in FIG. 2, the side wall of base portion 210 includes a notch or indentation 260 for receiving a corresponding latching member from the control unit 300. The opposite side wall of the base portion 210 is provided with a similar notch or indentation to likewise receive a corresponding latching member from the control unit 300. It will be appreciated that this pair of notches 260 on the base portion 200 (and the corresponding latching members of the control unit) provide a latch or snap fit connection for securely retaining the cartomizer 200 within the control unit 300 during operation of the device.

As also shown in FIG. 2, the bottom wall 211 of the base portion 210 includes two larger holes 212A, 212B on either side of a smaller hole 214 for air inlet into the cartomizer during user inhalation. The larger holes 212A and 212B are used to provide positive and negative electrical connections from the control unit 300 to the cartomizer 200, in particular to the heater and the PCB. When a user inhales through the mouthpiece 250 and the device 100 is activated, air flows into the cartomizer 200 through the air inlet hole 214. This incoming air flows past the heater (not visible in FIG. 2), which receives electrical power from the battery in the control unit 300 so as to vaporize liquid delivered to the heater from the reservoir by the wick. This vaporized liquid is then incorporated or entrained into the airflow through the cartomizer, and hence is drawn out of the cartomizer 200 through mouthpiece 250 for inhalation by the user.

Figure 3:
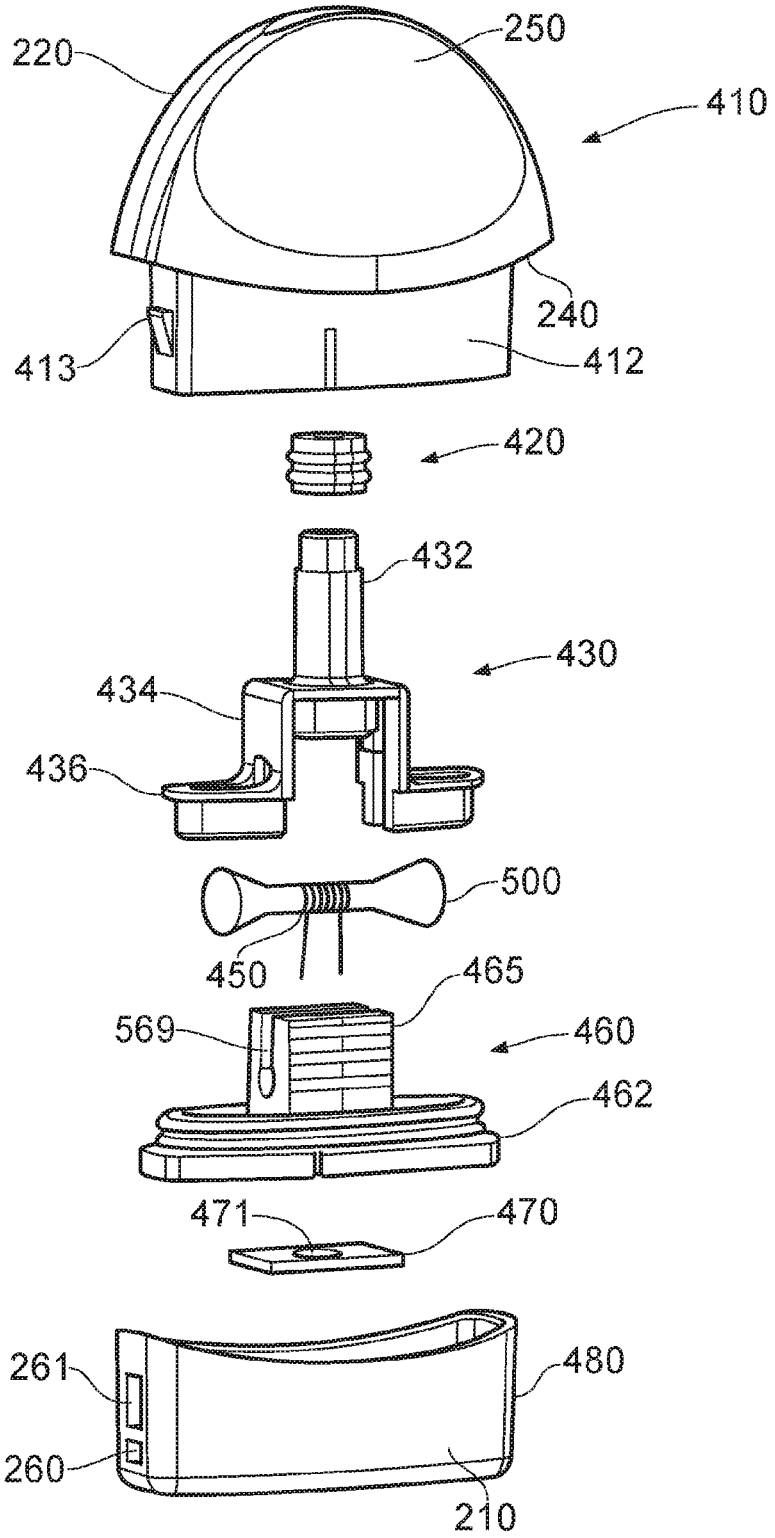
FIG. 3 shows an exploded view of the components of the example cartomizer of FIG. 2.

FIG. 3 is an exploded view of the cartomizer 200 of the e-cigarette of FIG. 1 in accordance with some embodiments. The cartomizer includes a shell 410, a vent seal 420, an inner frame 430, a heating coil 450 located on a wick 500, a primary seal 460 (also referred to as the cartomizer plug), a printed circuit board (PCB) 470 and an end cap 480. The view of FIG. 3 shows the above components exploded along the longitudinal (height or y) axis of the cartomizer 200.

The cap 480 is formed from substantially rigid plastic such as polypropylene and provides the base portion 210 of the cartomizer. The cap 480 is provided with two holes 260, 261 on each side. The lower hole 260 is for latching the cartomizer 200 to the control unit 300. The upper hole 261 is for latching the end cap 480 to the shell 410 to complete assembly of the cartomizer 410 and retain the various components shown in FIG. 3 in the correct position in the assembled cartomizer 410.

Above the end cap is located the PCB 470, which includes a central air hole 471 to allow air to flow through the PCB into the atomizer (the end cap 480 is likewise provided with a central air hole, shown in FIG. 2 as feature 214). In accordance with some embodiments, the PCB does not contain any active electrical components, but rather provides a circuit or conductive path between the control unit 300 and the heater 450.

Above the PCB 470 is located the primary seal 460, which has two main portions, an upper portion which defines (in part) an atomizer chamber 465, and a lower portion 462 which acts as an end seal for the reservoir 270. Note that in the assembled cartomizer 200, the reservoir of e-liquid is located around the outside of the atomizer chamber, and the e-liquid is prevented from leaving the cartomizer (at least in part) by the lower portion 462 of the cartomizer plug 460. The cartomizer plug 460 is made from a material that is slightly deformable, to allow the lower portion 462 to be compressed a little when inserted into the shell 410, and hence provide a good seal to retain the e-liquid in reservoir 270.

Two opposing side walls of the atomizer chamber 465 are provided with respective slots 569 into which the wick 500 is inserted. This configuration locates the heater 450, which is positioned on the wick 500, near the bottom of the atomizer chamber to vaporize liquid introduced into the atomizer chamber 465 by the wick 500. In some embodiments, the wick 500 is made of glass fiber rope (i.e. filaments or strands of glass fiber twisted together), and the heater coil 450 is made of nichrome (an alloy of nickel and chromium). However, various other formats of wick and heater are known and could be used in the cartomizer 200; these are discussed further below. The heater coil 450 has a wire lead dropping down from the wick at each end, by which the heater 450 is able to be electrically connected to the battery. The wick 500 has a flared shape, in that its end portions which reach into the reservoir 270 have an enlarged cross-section compared to its central portion around which the heater coil 450 is wrapped. The shape of the wick 500 is discussed further below.

The cartomizer plug 460 and the wick/heater assembly are surmounted by the inner frame 430, which has three main sections. The inner frame 430 is substantially rigid, and may be made of a material such as polybutylene terephthalate. The lowermost section 436 of the inner frame 430 engages with the lower portion 462 of the cartomizer plug 460, while the middle section 434 completes the atomizer chamber 465 of the cartomizer plug 460. In particular, the inner frame 430 provides a top wall of the atomizer chamber, and also two side walls that overlap with the two side walls of the atomizing chamber 465 provided by the cartomizer plug 460. The final section of the inner frame 430 is an airflow tube 432 that extends upwardly from the top wall of the atomizing chamber (part of the middle section 434) to connect with an outlet hole in the mouthpiece 250. The tube 432 provides a passage for vapor produced in the atomizing chamber 465 to be drawn out of the e-cigarette 100 by inhalation through the mouthpiece 250.

The vent seal 420 is inserted around the top of the airflow tube 432 to provide a seal between the inner frame and the outlet hole in the mouthpiece 250. The vent seal 420 is made of a suitably deformable and resilient material such as silicone. Lastly, the shell 410 provides the external surface of the upper portion 220 of the cartomizer 200, including the mouthpiece 250, and also the lip or flange 240, and also an outer wall for the reservoir 270 surrounding the atomizer chamber 465. The shell 410 is formed of a substantially rigid material, such as polypropylene. The lower section 412 of the shell 410, below the lip 240, sits inside the end cap 480 when the cartomizer 200 has been assembled. The shell 410 is provided with a latch tab 413 on each side to engage with the hole 261 on each side of the end cap 480, thereby retaining the cartomizer 200 in its assembled condition.

The airflow passage through the assembled cartomizer enters a central hole in the cap 480 (not visible in FIG. 3) and then passes through the hole 471 in the PCB. The airflow next passes up into the atomizer chamber 465, which is formed as part of the cartomizer plug 460, flows around, over and past the assembly of the wick 500 and the heater 450, and through the tube 432 of the inner frame 430 (and through vent seal 420), and finally exits through the hole (not shown) in the mouthpiece 250.

The reservoir 270 of e-liquid is contained in the space between this airflow passage and the outer surface of the cartomizer 200. Thus the shell 410 provides the outer walls (and top) of the reservoir 270, while the lower section 436 of the inner frame in conjunction with the base portion 462 of the primary seal 460 and end cap 480 provide the bottom or floor of the reservoir 270. The inner walls of the reservoir are provided by the atomizing chamber 465 of the primary seal 460, in cooperation with the middle section 434 of the inner frame, and also the airflow tube 432 of the inner frame 430 and the vent seal 420. In other words, the e-liquid is stored in the reservoir space between the outer walls and the inner walls. The wick 500 passes through apertures in the inner walls so that liquid from the reservoir 270 can penetrate inside the inner walls by way of absorption and wicking within the wick 500 to the heater 450. Other liquid penetration into the air flow passage should be minimized to inhibit liquid from leaking out of the hole in the mouthpiece 250.

The capacity of the space forming the reservoir 270 is typically of the order of 2 ml in accordance with some embodiments, although it will be appreciated that this capacity will vary according to the particular features of any given design. Note that unlike for some e-cigarettes, the e-liquid reservoir 270 is not provided with any absorbent material (such as cotton, sponge, foam, etc.) for holding the e-liquid. Rather, the reservoir chamber contains the liquid alone so that the liquid can move freely within the reservoir 270. Such a configuration may be referred to as a "free liquid" reservoir, and has advantages including generally supporting a larger capacity, and also making the filling procedure less complex.

Figure 4B:
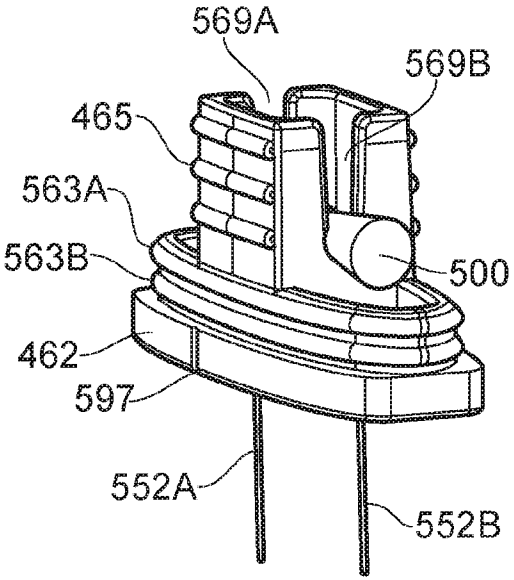
FIGS. 4A and 4B show perspective views of an example wick and heater assembly being fitted into a cartomizer plug included in the cartomizer of FIG. 2.
Figure 4A:
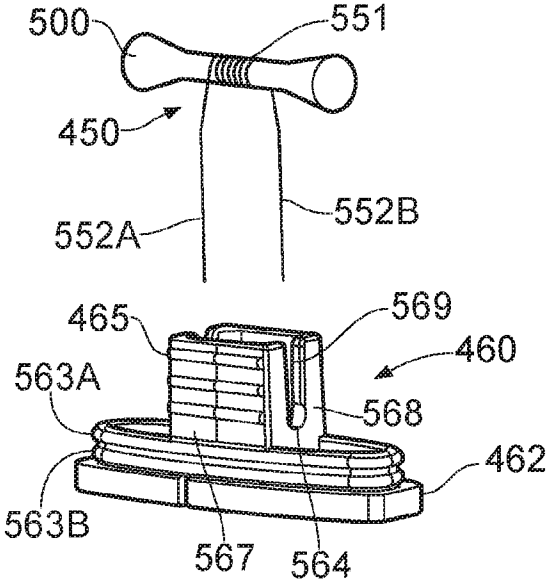

FIGS. 4A and 4B illustrate the wick/heater assembly being fitted into the cartomizer plug in accordance with some embodiments of the disclosure. The wick/heater assembly is formed from the heater wire 450 and the wick 500. In this example, the wick 500 comprises glass fibers formed into a generally elongate shape. The heater 450 comprises a coil of wire 551 wound around a central portion of the wick 500. At each end of the coil 551 there is a contact wire 552A, 552B, which together act as the positive and negative terminals to allow the coil 551 to receive electrical power.

As visible in FIG. 4A, the primary seal 460 includes the base portion 462 and the atomizing chamber 465. The atomizing chamber 465 comprises four walls in a rectangular arrangement, a pair of opposing side walls 568, and a pair of opposing front and back walls 567. Each of the opposing side walls 568 includes a slot 569 which has an open end at the top (and in the centre) of the side wall, and a closed end 564 relatively near the bottom of the atomizing chamber 465. The two slots 569 extend more than halfway down their respective side walls 568.

Referring now to FIG. 4B, this shows the wick/heater assembly fitted into the atomizing chamber 465 of the cartomizer plug. In particular, the wick/heater assembly is positioned so that the wick 500 extends between, and protrudes out of, the two opposing slots 569A, 569B, with the heater coil (not shown in FIG. 4B) located between the slots 569A, 569B so that it is inside the atomizer chamber 465. The wick 500 is lowered until it reaches the closed end 564 of each slot. In this position, the coil 551 is then located entirely in the atomizing chamber 465 and only the wick 500 that extends out of the slots reaches into the reservoir area 270. It will be appreciated that this arrangement allows the wick 500 to draw liquid from the reservoir 270 into the atomizing chamber 465 for vaporization by the wire heater coil 551. Having the wick 500 located near the bottom of the atomizing chamber 465, and more particularly also near the bottom of the reservoir 270, helps to ensure that the wick retains access to liquid in the reservoir even when the level of liquid drops as the liquid is consumed. FIG. 4B also shows how the heater contact wires 552A, 552B extend below the primary seal 460.

Figure 5B:
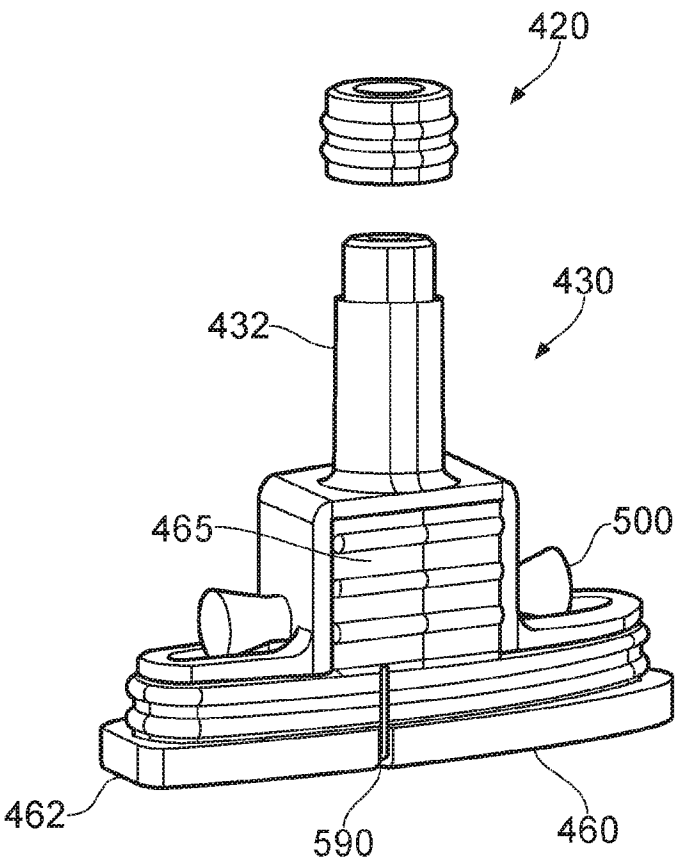
FIGS. 5A and 5B show perspective views of an inner frame and vent seal being fitted to the cartomizer plug of FIGS. 4A and 4B.
Figure 5A:
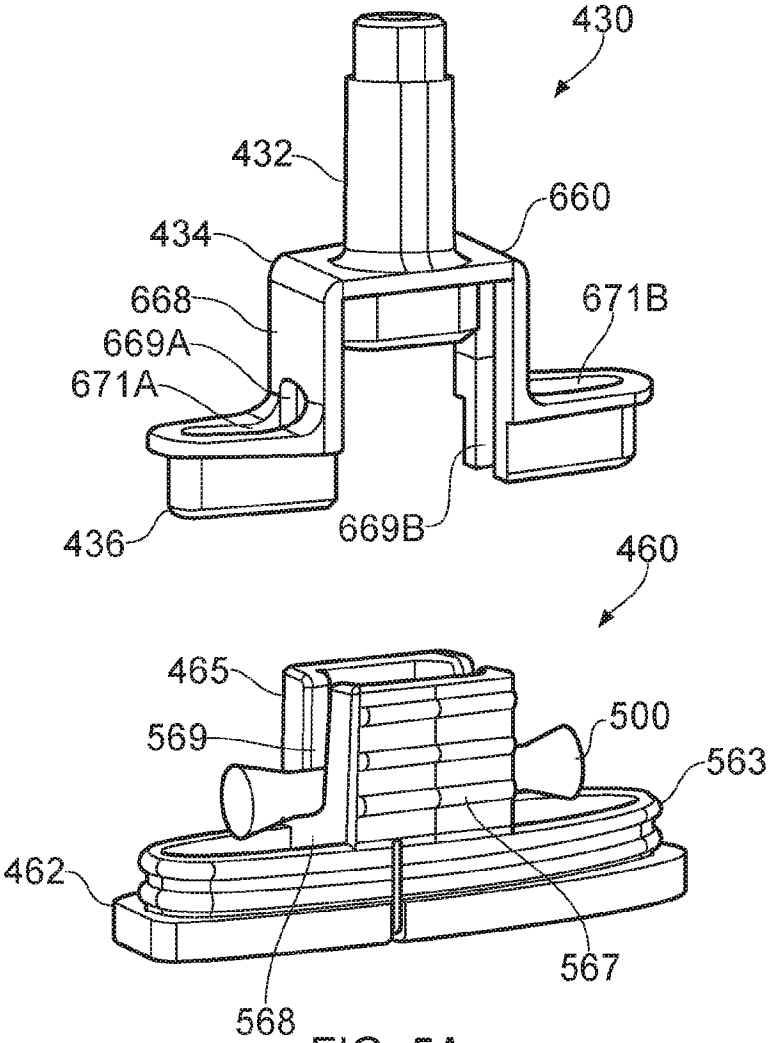

FIGS. 5A and 5B illustrate the inner frame and the vent seal being fitted into the cartomizer plug in accordance with some embodiments of the disclosure. Thus, as previously described, the inner frame 430 comprises a base section 436, a middle section 434 and an air tube 432 located at the top of the inner frame. The base section contains two slots 671A, 671B extending in a horizontal sideways direction (parallel to the x axis). As the base section 436 of the inner frame is lowered down past the atomizing chamber 465, the portions of the wick 500 that extend out from each side of the atomizing chamber 465 pass through these slots 671A, 671B, thereby allowing the base section of the inner frame to be lowered further until it is received in the lower portion 462 of the cartomizer plug.

As noted above, the middle section 434 of the inner frame complements and completes the atomizing chamber 465 of the cartomizer plug 460. In particular, the middle section provides two opposing side walls 668 and a top wall or roof 660. The latter closes the top of the atomizing chamber 465, except in respect of the air tube 432 which extends up from the atomizing chamber 465 to the outlet hole of the mouthpiece 250.

Each of the opposing side walls 668 includes a slot 669A, 669B which extends upwards (parallel to the y axis) from the bottom of the side wall to the closed end of the respective slot. Accordingly, as the base section 436 of the inner frame is lowered down past the atomizing chamber 465, the portions of the wick 500 that extend out from each side of the atomizing chamber 465 pass through these slots 669A, 669B (in addition to slots 671A, 671B). This therefore allows the side walls 668 of the inner frame 430 to overlap the side walls 568 of the cartomizer plug. Further downward movement of the inner frame 430 is prevented once the closed end of slots 669A, 669B contacts the wick 500, which coincides with the base section 436 of the inner frame being received into the lower portion 462 of the cartomizer plug. At this stage, the combination of cartomizer plug 460, heater/wick assembly, and inner frame 430, has been formed as shown in FIG. 5B, and the vent seal 420 can now be fitted onto the air tube (pipe) 432 of the inner frame 430.

Figure 6B:
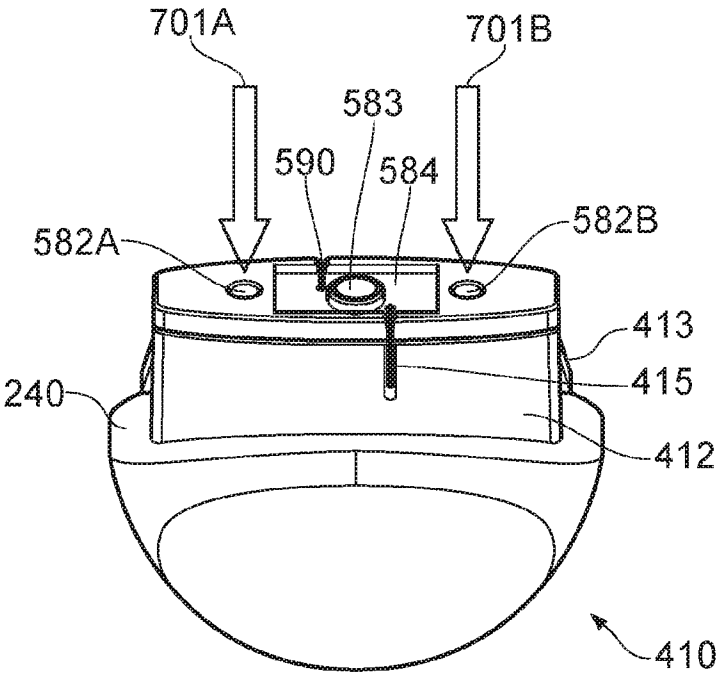
FIG. 6B shows a perspective view of the reservoir formed in FIG. 6A being filled with source liquid.
Figure 6A:
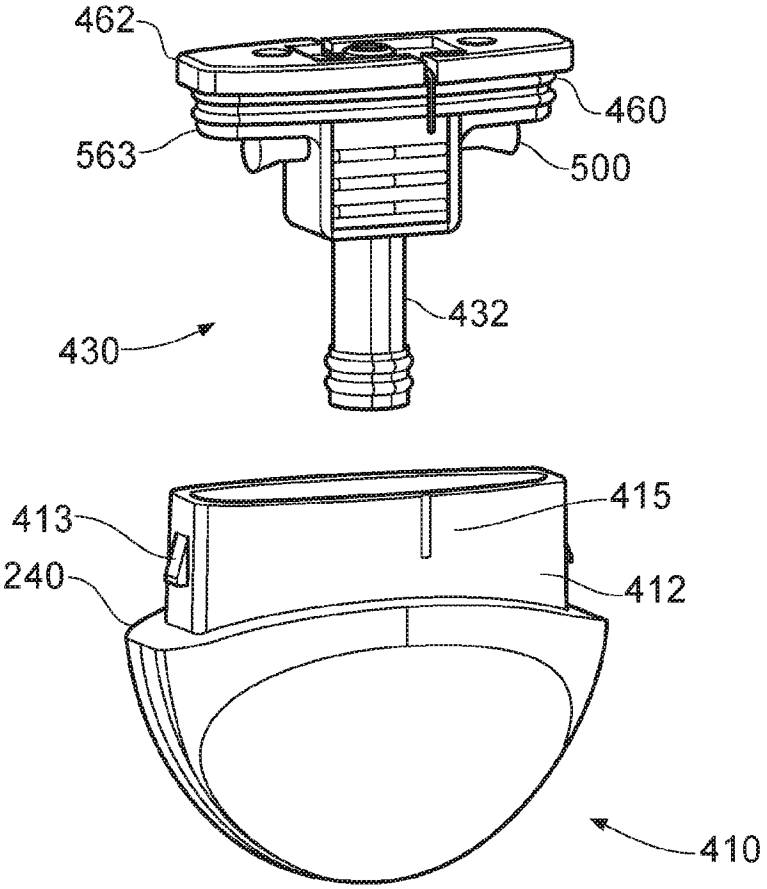
FIG. 6A shows a perspective view of the FIGS. 4A to 5B components being fitted into a shell of the cartomizer of FIG. 2 to form a reservoir.

FIG. 6A illustrates the combination of the inner frame 430, wick/heater assembly, and primary seal 460 being fitted into the shell 410. The various walls that define the reservoir 270 are thereby brought into conjunction to create the reservoir, so the cartomizer 200 is now ready for filling with source liquid.

FIG. 6B shows the cartomizer 200 assembled up to this point. Filling with liquid is performed, as indicated by arrows 701A, 701B, through holes 582A and 582B in the primary seal 460 and through slots 671A, 671B in the inner frame 430. To complete the cartomizer 200 as it is depicted in FIG. 2, the PCB 470 is installed in a rectangular indentation 584 in the underside of the primary seal 460, and the end cap 480 is fitted over the end of the cartomizer plug 460 and the lower section 412 of the shell 410. In this fully assembled state (see FIG. 2), the end cap 480 covers and therefore closes the holes 582A, 582B in the cartomizer plug that were used for filling the liquid reservoir 270. Accordingly, the reservoir 270 is now fully sealed, apart from the opening on each side of the atomizing chamber 465 through which the wick 500 passes into the atomizing chamber 465.

Figure 7:
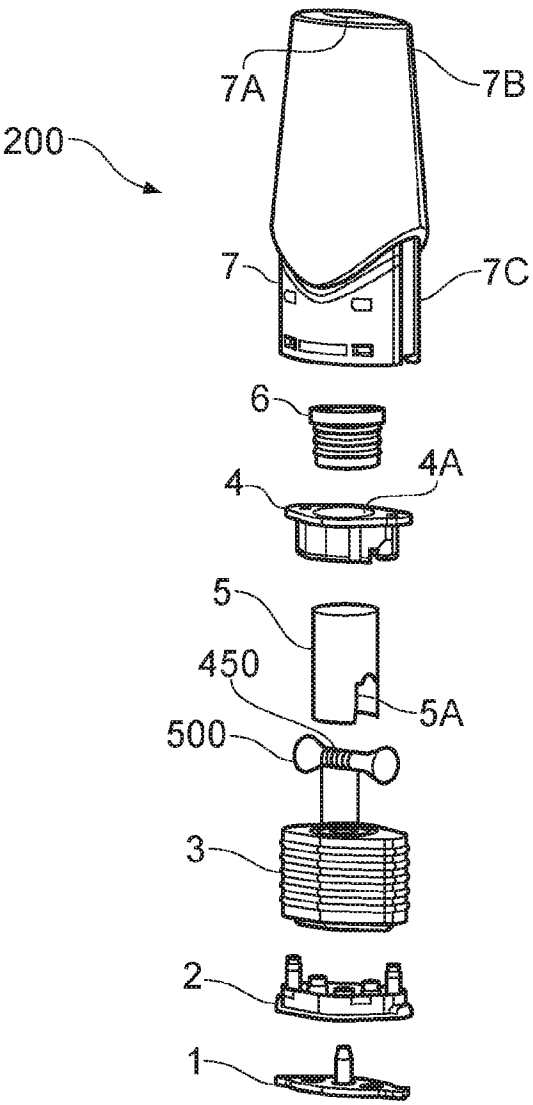
FIG. 7 shows an exploded view of components of a further example cartomizer in which embodiments may be implemented.

An electronic cigarette may be configured otherwise than in the example described thus far while including a flared wick. FIG. 7 shows an exploded view of components of a cartomizer according to a further example. Many of the components are similar to those of the FIGS. 1-6 example, but differently shaped so that the cartomizer has a more elongate and less flat shape. The cartomizer is composed of a base part 1 that forms the lower face of the cartomizer. A bottom plug 2 closes the lower end of a reservoir, which is otherwise comprised by a wall portion 3 in the form of an annular outer wall that engages into the plug 2 and a top plug or seal 4 which engages into the top end of the wall portion 3. A flared wick 500 has a heater coil 450 wrapped around it, and is located within the volume defined by the wall portion 3. A tubular air channel 5 sits inside the wall portion 3 so that it surrounds the wick 500 and heater 450, partitioning these parts from the reservoir and forming an atomizing chamber. The tubular channel 5 comprises an oppositely disposed pair of slots 5A extending upwardly from its lower edge, and the end portions of the wick 500 are receiving in these slots so as to reach into the reservoir for the purpose of collecting liquid from the reservoir. A vent seal 6 is pushed into an opening 4A in the top plug 4; this is aligned with the tubular channel 5A. A hollow shell 7 forms the exterior of the cartomizer 200, and receives the other components within itself to align the air channel formed by the tubular channel 5 and the vent seal 6 with an air outlet 7A in a mouthpiece 7B of the shell 7. The base part closes the lower end of the shell 7. A lower portion 7C of the shell 7 is recessed compared to the mouthpiece 7B, to be received inside an upper part of a control unit, similar to the connected arrangement of the FIGS. 1-6 example.

Embodiments of the disclosure are not limited to these example devices, and may be implemented in vapor provision systems configured in other ways.

It will be appreciated from these examples that the reservoir of an electronic cigarette can comprise a relatively small volume, formed by closely spaced walls. The wick necessarily protrudes into this volume to be able to absorb the liquid contained in the reservoir, but there may be very little space available to accommodate it. Accordingly, when the reservoir is filled, air bubbles may be trapped around the wick, such as between the ends of the wick and the outer wall of the reservoir. Surface tension of the liquid may also inhibit flow of the liquid around the wick, both during filling and during subsequent use. Proper filling of the reservoir may thus be prevented, giving a reduced effective reservoir capacity. Also, absorption of liquid by the wick may be inhibited if liquid does not fully surround the wick ends owing to air bubbles and surface tension effects.

To address this, it is proposed to provide a shaped wick which flares out at the portion or portions that extend into the reservoir. This increased width or cross-section improves absorption of liquid by the wick so that liquid transfer from the reservoir to the heater is enhanced, and consistent vapor production can be maintained.

The wick or wicking element can comprise any suitable porous material, having a pore structure that provides a wicking capability to transport liquid absorbed by one part of the material (a part inside a reservoir of liquid) to another part (adjacent a heating element) by a capillary action. Example materials include fiber-based structures such as bundles, strands, threads, ribbons or ropes formed from woven, non-woven, spun, plaited or twisted fibers of cotton, wool, glass or artificial fibers, or solid/rigid non-fiber-based materials with integral interstitial pores, such as porous ceramics. The manner in which the flared shape is provided will be appropriate to the material used for the wick.

A porous ceramic or other solid material may be fabricated directly into the required flared shape, for example by molding or machining. A density of the wick material may be substantially the same at the flared end parts as in the part adjacent the heating element. Alternatively, the size and/or distribution of the pores may differ at the end part compared to the heating portion, for example with a larger pore size and/or a higher density of pores at the end part or parts, and smaller pore size and/or lower density of pores in the part adjacent the heating element. In other words, the porosity varies across the wick, with a higher porosity in the flared part or parts intended to be immersed in the reservoir and a lower porosity in the vicinity of the heating element. The larger volume of porous material, and optionally the larger pore size/higher pore quantity/higher porosity, of the flared portion(s) will all aid in improving the ability of the wick material to absorb liquid from the reservoir.

For a fibrous wick, the cross-section at the reservoir ends may be enlarged compared to the heating part by fraying or unraveling fibers which are woven, spun, twisted and/or bundled together, and spreading or splaying the resulting separated fibers or strands of fibers away from each other. Individual fibers may be separated from each other, or individual plies comprising two or more fibers may be separated from each other, or a combination of the two, depending on the configuration of the fibers. Any such arrangement which increases the fiber-to-fiber spacing of at least some of the adjacent fibers in the enlarged part of the wick might be employed. This has the effect of reducing the density of the wick material in the flared sections, since the fibers have a larger separation and are less tightly packed together compared to the heater portion. A similar effect may be achieved by using a relatively loosely spun, woven or twisted length of fibers, or a loosely packed bundle of fibers, and compressing or squashing one part to form a heater section. The remaining uncompressed part or parts will be splayed out compared to the compressed part and hence have a larger cross-section. The compression or confinement of the heater portion of the wick may be maintained by tying or wrapping further fibers around the wick fiber or fiber bundle; these securing fibers may be the same as or different from the wick material. Alternatively, the heating element may be used to compress the fibers if it has the form of a wire coil; the wire may be tightly wrapped around a fiber or fiber bundle to squeeze the fibers together at the same time as forming a coil.

Figure 8:
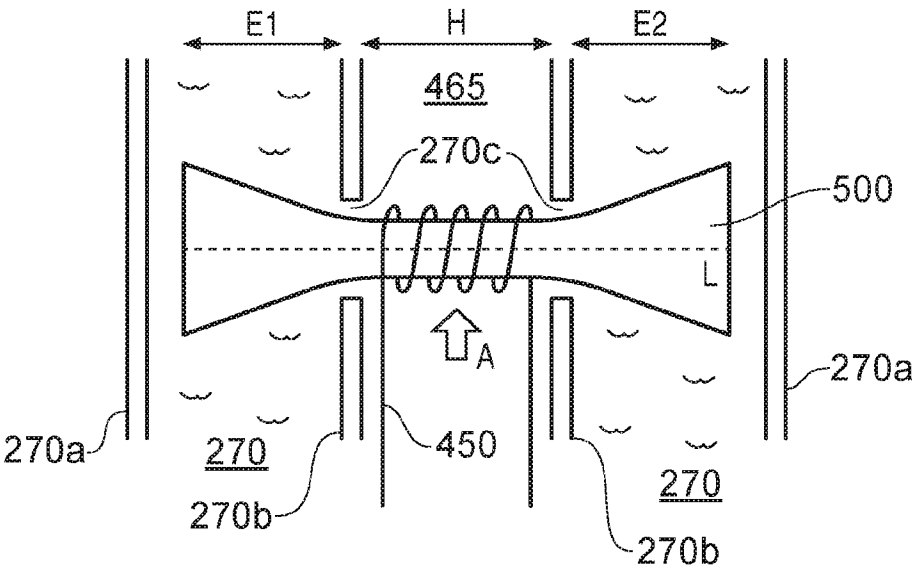
FIG. 8 shows a partial cross-sectional side view of an example aerosol source for a cartomizer.

FIG. 8 shows a schematic side view of a simple example flared wick generally in accordance with embodiments of the disclosure, shown inside a partial cross-sectional view of a section of a cartomizer. The wick 500 has a central portion H disposed inside an atomizing chamber 465, extending across the chamber perpendicularly to the direction of airflow through the chamber (indicated by the arrow A). A heater 450 in the form of a wire coil is wrapped around the central portion H. Accordingly this part of the wick 500 may be considered as a heater portion, a heated portion or a heating element portion, or alternatively an atomizing portion. The atomizing chamber 465 is bounded by an annular wall 270*b* (shown in cross-section), on the far side (outside) of which lies a reservoir 270 of source liquid. An outer annular wall 270*a* forms the outside of the reservoir 270, and possibly also the exterior wall of the cartomizer. The reservoir is hence also annular and surrounds the atomizing chamber 465. The reservoir 270 contains only source liquid, so that the liquid is free-flowing within the reservoir.

The inner annular wall 270*b* has two oppositely arranged apertures 270*c* in it, aligned perpendicularly to the airflow A, and the wick 250 has end portions E1, E2 which are continuous with the heater portion H, but extend through the apertures 270*c* to reach into the interior of the reservoir 270 for the purpose of absorbing liquid held in the reservoir 270. The end portions E1, E2 may therefore be considered as liquid-collecting portions, liquid absorbing portions, or reservoir portions. The wick has an axis L indicated by a dotted line which is designated as a longitudinal axis, although this does not imply that the extent of the wick along the direction of the axis L is necessarily its largest dimension. In this example, the longitudinal axis is arranged orthogonally to the direction of airflow A. Also, the longitudinal axis is straight, and the heater portion H and the end portions E1, E2 are arranged contiguously along the axis L so that the wick has an overall straight linear configuration, and might be considered as elongate. The longitudinal axis may be curved or bent in other configurations, however.

Each of the end portions E1, E2 has a flared (or, conversely, tapered) shape, in that a cross-section through the wick in a plane perpendicular to the longitudinal axis L is larger along at least one dimension at an end portion E1, E2 than at the heater portion H. This may be thought of as the wick having a length (along the L direction), and a width at its end portions which is larger than a width at its heater portion, where the width is orthogonal to the length. Similarly or alternatively, a perimeter (which may be a circumference if the wick has a generally circular cross-section or rod-like format) of the end portions is larger than a perimeter of the heater portion. The heater portion, being the part inside the atomizing chamber, on a first side of the wall separating the atomizing chamber from the reservoir, may have a constant or average width, diameter, perimeter, circumference or cross-sectional area over its length, and each end portion, being the part in the reservoir, on a second side of the separating wall, may have a greatest width, diameter, perimeter, circumference or cross-sectional area which is larger than the corresponding constant or average parameter for the heater portion. The flared shaped may also be described as the wick having a width, perimeter or cross-sectional area which increases from a first value at a heater portion of the wick, or at a position where the wick aligns with the aperture in the separating wall, to a second value at an end, liquid-collecting, portion of the wick, where the second value is larger than the first value. The increase may be in a single dimension only orthogonal to the axis L (such as thickness only or height only), or may be in two dimensions orthogonal to the axis L and to each other (thickness and height). Both the thickness and the height may conveniently be designated as a width, being a dimension orthogonal (transverse) to the longitudinal axis of the relevant portion of the wick, namely a local longitudinal axis. In wicks with a circular cross section, the width is a diameter. An increase over two dimensions may or may not be such as to maintain the same cross-sectional shape (but not size) from the heater portion to the end portions. Note that the greatest (widest) part of the end portion(s) of the wick may or may not be at its physical extremity, depending on the external shape adopted for the end part.

The various measures of width, diameter, thickness, height, perimeter, circumference and cross-sectional area are all of interest, and a constant (linear) or varying (non-linear) increase in any of these measures over at least part of the longitudinal extent of a wick end portion can be implemented to provide a flared shape. The measures are all features of the cross-section of the wick at the location of interest, so may collectively be designated as cross-sectional parameters, cross-sectional measures, cross-sectional values, or cross-sectional numerical values. Within this set of parameters, the width measures (thickness, height, diameter) are linear measures, so may be considered as cross-sectional dimensions, since "dimension" typically denotes a linear extent.

Figure 8A:
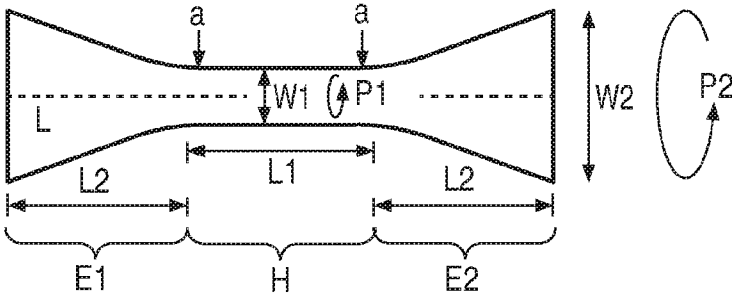
FIG. 8A shows a schematic side view of an example wick.

FIG. 8A shows a schematic side view of an example wick to illustrate the flared configuration. A central heater portion H has a longitudinal extent L1 along the axis L, a width W1 perpendicular to the axis L and a perimeter P1 in a plane perpendicular to the axis L. On each side of the central portion, the width (and hence also the perimeter) increases to form end portions E1 and E2 which terminate to a maximum width W2 greater than W1 and a maximum perimeter P1 greater than P2. A first end portion E1 has a length L2 along the axis L, and the second end portion E2 has a length L2 along the axis L. The boundary or junction between the central portion H and each end portion E1, E2 is indicated as "a", and marks the point where the wick is intended to pass through an aperture in a wall of a reservoir (correspondingly, a wall of the atomizing chamber housing the heater). This junction or boundary may be considered as a "neck" of the end portion, beyond which the wick flares outwards. The junctions "a" will align with the reservoir wall, and indicate the location where the heater portion of the wick transitions into an end portion. The two widths W1 and W2 are separated in the longitudinal dimension L along the length of the generally elongate wick, where L is orthogonal to the width dimension. The increase in dimension to form the flare may be linear so that the sides of the wick in the end portions are straight, and angled outwards with respect to the central portion, as in the FIG. 8 example. In the FIG. 8A example, the increasing width is nonlinear so that the width increases more rapidly towards the ends of the wick, giving curved sides to the wick 500 so that each end has a "trumpet" shape. A combination of linear and nonlinear increases may be used to give a desired profile for the wick 500. The increase in width/perimeter/cross-section of the end portion compared to the central portion may commence at the location of the boundary "a", or at any location after the point "a", towards the physical end of the wick, remote from the heater portion and within the end portion, or before the point "a", away from the physical end of the wick and within the heater portion.

Note that in the FIGS. 8 and 8A examples, the largest width/perimeter (W2 or P2) for the end portions is at their extremity, but this need not be the case.

Regular shapes such as in FIGS. 8 and 8A may be obtained for a solid wick material such a porous ceramic. Wicks formed from fibers or fiber bundles may have a less regular, more ragged shape, within a flared outline, but the overall impression will be the same, with a clearly increased width and perimeter for the end portions compared to the heater portion.

The greater dimension for the end portions may be larger or smaller compared to the central portion as required. Any flaring of the end sections can have a positive effect on wicking, with greater flaring producing a more noticeable effect. So, width (or depth or thickness) W2 is greater than W1 such that W2/W1 has any value greater than 1. For example, W2/W1 may be at least 1.25, or at least 1.5, or least 2, or at least 3, or at least 4 or at least 5. In terms of circumference or perimeter (in other words, the measurement around the wick at the position of the width of interest), P2 is greater than P1 such that P2/P1 has any value greater than 1. For example, P2/P1 may be at least 1.25, or at least 1.5, or at least 2, or at least 3, or at least 4, or at least 5. In terms of cross-sectional area orthogonal to the longitudinal axis, the maximum area A2 of the end portion is greater than the area A1 of the heater portion such that A2/A1 has any value greater than 1. For example, A2/A1 may be at least 1.25, or at least 1.5, or least 2, or at least 3, or at least 4 or at least 5.

In many examples, the heater portion will be of a generally constant thickness or width, so that the width W1, the perimeter P1 and the cross-sectional area A1 are the same in the middle of the wick (and at other intermediate locations) as at the neck location where the end portion begins. However, this need not be the case, and the heater portion may have a variable cross-section. In this case, a value for W1 or P1 or A1 for comparison with the equivalent parameter W2 or P2 or A2 for the end portion can be taken from the width or the perimeter or the cross-sectional area at the neck.

Figure 9:
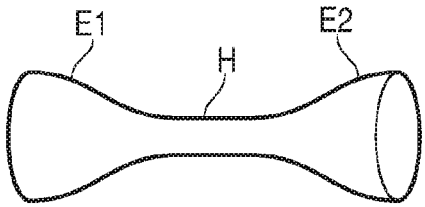
FIGS. 9, 10 and 11 show schematic side views of further example wicks.

FIG. 9 shows a perspective view of an example wick with a generally circular cross-section, and in which the increased parameter or parameters to form the flared ends E1, E2 is in two dimensions, so that the circular cross-section is preserved from the central portion H to the end portions E1, E2. The increase is non-linear so that the wick as a curved profile. The overall shape of the wick may be considered as a "dumb-bell" shape.

Figure 10:
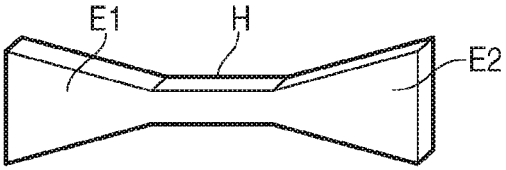

FIG. 10 shows a perspective view of an example wick in which the increase to form the flared shape is in one dimension only. The central portion H has a square cross-section. In the end portions E1, E2, the width in the thickness direction (as illustrated, into the plane of the page) stays the same as for the central portion H, but the width in the height direction (as illustrated, vertically in the plane of the page) increases linearly over the longitudinal extent of the end portions. The overall shape of the wick may be considered as a "bow-tie" shape.

As a further example, a wick with a central square portion as in FIG. 10 may have a two-dimension increased width as in FIG. 9, to preserve the square cross-section within the end portions. Also, a flat-sided heater portion may expand into curved or rounded end portions, or a curved or rounded heater portion may expand into flat end portions. There is no requirement to preserve any shape or geometrical features from the heater portion to the end portions, merely that there is at least one transverse dimensional increase to achieve the flared shape.

Figure 11:
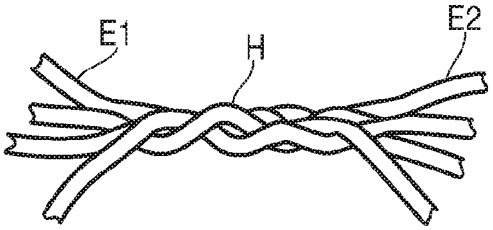

FIG. 11 shows a perspective view of an example wick formed from a bundle of fibers. In the central portion H, the fibers are spun or twisted together. In the end portions E1, E2, the fibers are separated from each other and spaced apart. Hence the width of the end portions is larger than the width of the central portion. Such a configuration can be achieved by taking a length of bundled fibers previously twisted, spun, intertwined, woven or plaited together, and unraveling the fibers at each end of the length to splay them into a flared shaped. Alternatively, individual fibers may be taken, and twisted, spun, intertwined, woven or plaited together in a central region to form a narrower bundle for the heater portion of the wick. Alternatively, as mentioned above, the central narrower bundle might be formed by binding, tying or wrapping a central region of the bundle to compress and confine the fibers in that region, using additional fibers of a same or a different type, or by using the coils of a heating element.

The examples thus far have comprised wicks with a central heater portion and two end portions, in a linear alignment with the heater portion in the centre between the end portions. Such an arrangement is convenient for an annular reservoir surrounding an atomizing chamber, where it is desired for the wick to reach across the chamber and into the reservoir on two opposite sides. However, the present embodiments are not limited in this regard, and the wick may comprise any number of flared end portions intended for immersion in a reservoir and contiguous with a heater portion intended for location in an atomizing chamber.

Figure 12:
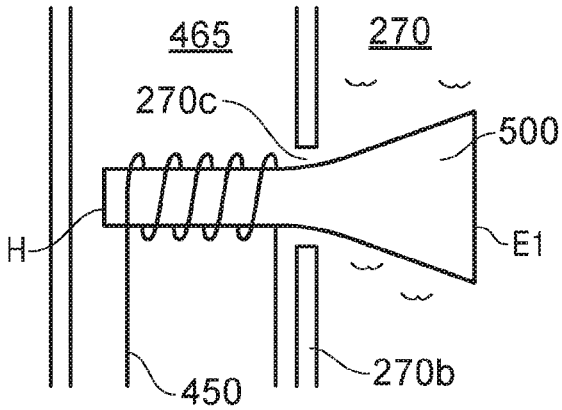
FIG. 12 shows a partial cross-sectional side view of a further example aerosol source.

FIG. 12 shows a simplified partial cross-section of an example wick with one flared end. The wick comprises a heater portion H linearly arranged continuously with a single end portion E1. The heater portion H is provided with a heating element 450 in the form of a wire coil wrapped around the wick; these parts are disposed in an atomizing chamber 465. A wall 270*b* divides the atomizing chamber 465 from a reservoir 270, and the wick is arranged to extend through an aperture 270*c* in the wall so that the flared end portion E is situated inside the reservoir.

Figure 13:
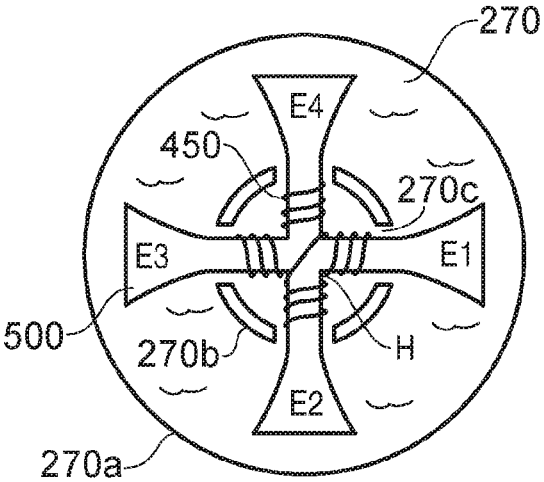
FIG. 13 shows a partial transverse cross-sectional view of a yet further example aerosol source.

FIG. 13 shows a simplified view of an example wick with four flared ends, shown in transverse cross-section through an aerosol source (i.e. perpendicular to the airflow direction, which will be into the plane of the page). It is known to configure an atomizer to comprise a pair of wicks, each with a heating element, and arrange them in a cross shape with respect to air flow through an atomizing chamber surrounded by an annular reservoir, so that both ends of each wick reach into the reservoir. The present disclosure invention may be applied to such an arrangement, either by flaring the ends of two separate two-ended wicks, or by providing a single cross-shaped wick in which each of the four arms terminate in a flared end portion. FIG. 13 shows an example of this configuration. The wick 500 has a central portion H in the form of a cross, which is surrounded by a heating element 450 which may comprise one, two or more wire coils, for example. This portion is located in an atomizing chamber which is divided from an annular reservoir 270 by an inner annular wall 270*b*. An outer annular wall 270*a* forms the exterior of the reservoir 270. The inner wall 270*b* has four apertures 270*c*, aligned with the four arms of the wick 500 so that the arms extend through the apertures 270*c* into the reservoir, wherein one or more transverse dimensions of the arms are increased to form flared end portions E1-E4 for liquid absorption. The wick might be considered to have a "Maltese cross" shape.

For wick configurations having more than one flared end portion, each end portion may or may not be the same size and shape. End portions of the same size and shape provide a symmetric wick, whereas differing end portions (by size and/or shape and/or amount of flare) provide an asymmetric wick which may be preferred in some cases, depending on the configuration and arrangement of the atomizing chamber and the reservoir. For end portions or arms with differing amounts of flare, each arm will have a width or perimeter or cross sectional area which is greater than that of the heater portion, but may differ from that of the other arm or arms.

The examples already presented have each assumed an atomizer configuration (the combination of a wick and a heater) in which a heating element is provided externally to a wick, for example the heater is a coil wrapped around a (central) heater portion of the wick. The disclosure is not limited in this regard, however. As an alternative, the heating element may be embedded within the porous material of the wick, at the location of the heater portion intended to be arranged within an atomizing chamber.

Figure 14:
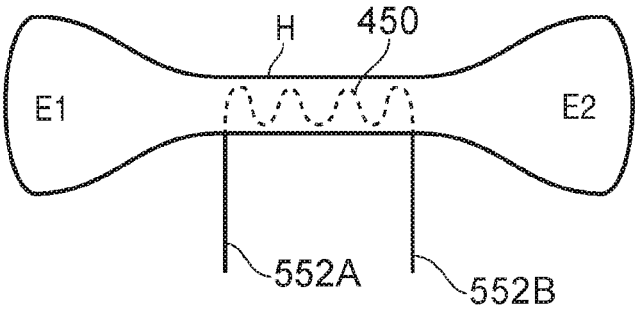
FIG. 14 shows a schematic side view of an example wick and heater assembly.

FIG. 14 shows a simplified side view of an example wick with an embedded heater. The wick 500 has a central heater portion H and two flared ends E1, E2. Note that the ends terminate in a rounded shape, and are hence an example in which the maximum width/area/perimeter of the flared ends is located inwardly from the physical extremity of the wick. A heater 450 in the form of a wire is disposed within the wick material of the heater portion H, and has follows a serpentine path in this region, with two external leads 552A and 552B extending from the serpentine section to the exterior of the wick 500 for electrical connection of the heater 450. The heater may have any shape within the wick material, and may be formed from wire or from a conductive layer, for example. Similarly, external heating elements may take any shape and are not limited to coils.

Note that while the Figures depict various examples of flared wicks in simple outline which may suggest a solid wick material such as porous ceramic, any of the various shapes and configurations, plus others within the scope of the disclosure which will be apparent to the skilled person, can be configured in a fiber-based format or a sold material format.

Further, while the end portion(s) of the wick and the heater portions are adjacent to one another, they need not be arranged along a straight line. In other words, the longitudinal axis (L in FIGS. 8 and 8A) need not be a straight line. There may be one more bends in the axis, for example, a two-ended wick may have a U-shape, in which the end portions form an angle of around 90 degrees to the heater portion. Nevertheless, the end portions will still have a width greater than a width of the heater portion, measured orthogonally with respect to the local longitudinal axis regardless of any bends, turns or angles in the axis as a whole. Also, one may define the flared, increased width of the end portion or portions of the wick as the end portion having a maximum width, perimeter or cross-sectional area that is larger than a width, perimeter or cross-sectional area of the wick at the point (the neck of the end portion) where it is intended to pass through an aperture in the wall of the atomizing chamber to reach into the reservoir.

In conclusion, in order to address various issues and advance the art, this disclosure shows by way of illustration various embodiments in which the claimed invention(s) may be practiced. The advantages and features of the disclosure are of a representative sample of embodiments only, and are not exhaustive and/or exclusive. They are presented only to assist in understanding and to teach the claimed invention (s). It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope of the claims. Various embodiments may suitably comprise, consist of, or consist essentially of, various combinations of the disclosed elements, components, features, parts, steps, means, etc. other than those specifically described herein. The disclosure may include other inventions not presently claimed, but which may be claimed in future.

The invention claimed is:

1. An aerosol source for an electronic vapor provision system comprising:

a heating element;

an atomizing chamber;

a reservoir for holding free-flowing source liquid;

a porous wick extending from the atomizing chamber to the reservoir and comprising a heater portion in cooperation with the heating element within the atomizing chamber such that the heating element is external to the heater portion or disposed within the heater portion, and at least one liquid collecting portion within the reservoir, the at least one liquid collecting portion having a maximum perimeter that is greater than a perimeter of the heater portion;

wherein the porous wick is formed from a porous non-fiber-based material with integral interstitial pores.

2. The aerosol source according to claim 1, wherein the heating element is formed as a wire.

3. The aerosol source according to claim 1, wherein the heating element is formed from a conductive layer.

4. The aerosol source according to claim 1, wherein the porous wick is formed from a porous ceramic material.

5. The aerosol source according to claim 1, wherein a ratio of the maximum perimeter of the at least one liquid collecting portion to the perimeter of the heater portion is at least 1.25, or at least 1.5, or at least 2, or at least 3, or at least 4, or at least 5.

6. The aerosol source according to claim 1, wherein the perimeter of the at least one liquid collecting portion has a linear increase over at least part of a longitudinal extent of the at least one liquid collecting portion.

7. The aerosol source according to claim 1, wherein the perimeter of the at least one liquid collecting portion has a non-linear increase over at least part of a longitudinal extent of the at least one liquid collecting portion.

8. The aerosol source according to claim 1, wherein the porous wick has a density which is substantially the same in the at least one liquid collecting portion and in the heater portion.

9. The aerosol source according to claim 1, wherein the porous wick has a porosity which varies across the porous wick.

10. The aerosol source according to claim 9, wherein the porous wick has a porosity which is higher in the at least one liquid collecting portion than in the heater portion.

11. The aerosol source according to claim 1, wherein the wick has a generally circular cross-section.

12. The aerosol source according to claim 1, wherein the wick has a generally square cross-section.

13. The aerosol source according to claim 1, wherein the heater portion has a different cross-sectional shape from the at least one liquid collecting portion.

14. The aerosol source according to claim 1, wherein the at least one liquid collecting portion comprises two liquid collecting portions, and the wick is symmetric, the two liquid collecting portions having the same size and shape.

15. The aerosol source according to claim 1, wherein the at least one liquid collecting portion comprises two liquid collecting portions, and the wick is asymmetric, the two liquid collecting portions have a different shape and/or size.

16. An atomizer for an electronic vapour provision system comprising:

a heating element; and a porous wick comprising a heater portion in cooperation with the heating element such that the heating element is external to the heater portion or disposed within the heater portion, and at least one liquid collecting portion contiguous with the heater portion for placement in a reservoir of source liquid, the at least one liquid collecting portion having a maximum perimeter that is greater than a perimeter of the heater portion;

wherein the porous wick is formed from a porous non-fiber-based material with integral interstitial pores.

17. A wick for an atomizer of an electronic vapor provision system, made from porous non-fiber-based material with integral interstitial pores and comprising:

a heater portion for cooperation with a heating element formed as a wire such that the heating element is external to the heater portion or disposed within the heater portion; and at least one liquid collecting portion contiguous with the heater portion for placement in a reservoir of source liquid, the at least one liquid collecting portion having a maximum perimeter that is greater than a perimeter of the heater portion.

18. A cartomizer for an electronic vapor provision system comprising an aerosol source according to claim 1.

19. A cartomizer for an electronic vapor provision system comprising an atomizer according to claim 16.

20. A cartomizer for an electronic vapor provision system comprising a wick according to claim 17.

* * * * *